US006375029B2

(12) United States Patent
Anthony et al.

(10) Patent No.: US 6,375,029 B2
(45) **Date of Patent: *Apr. 23, 2002**

(54) EASY-OPEN MISTING CONTAINER

(75) Inventors: Michael J. Anthony, Pittsburgh; Eileen M. Smith, Apollo; Andrew F. Clarke, Lower Burrell; George P. Kurzdorfer, Pittsburgh, all of PA (US)

(73) Assignee: Alcoa Inc., Pittsburgh, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/294,982

(22) Filed: Apr. 19, 1999

(51) Int. Cl.[7] ..... B65D 17/34
(52) U.S. Cl. ..... 220/271; 220/906
(58) Field of Search ..... 220/269, 270, 220/271, 906; 413/12, 14, 15, 16, 17, 25

(56) References Cited

U.S. PATENT DOCUMENTS

| | | | | |
|---|---|---|---|---|
| 3,416,699 | A | 12/1968 | Bozek | 220/54 |
| 3,690,506 | A | 9/1972 | Kennedy et al. | 220/54 |
| 3,951,299 | A | 4/1976 | Khoury | 220/273 |
| 4,015,744 | A | 4/1977 | Brown | 220/269 |
| 4,030,631 | A | 6/1977 | Brown | 220/269 |
| 4,043,479 | A * | 8/1977 | Khoury | 220/271 |
| 4,146,149 | A | 3/1979 | Beveridge | 220/271 |
| 4,205,759 | A | 6/1980 | Koller | 220/271 |
| 4,465,204 | A | 8/1984 | Kaminski et al. | 220/269 |
| 4,503,989 | A | 3/1985 | Brown et al. | 220/269 |
| 4,530,631 | A | 7/1985 | Kaminski et al. | 413/12 |
| 4,610,156 | A | 9/1986 | Kaminski et al. | 72/431 |
| D289,017 | S | 3/1987 | Spangler et al. | D9/438 |
| 4,741,451 | A | 5/1988 | Hobbs | 220/271 |
| 4,901,877 | A * | 2/1990 | Hall | 220/269 |
| 4,928,845 | A | 5/1990 | Doyle | 220/271 |
| 5,692,636 | A | 12/1997 | Schubert | 220/271 |
| 5,738,237 | A | 4/1998 | McEldowney | 220/269 |
| 5,799,815 | A | 9/1998 | Lang | 220/258 |
| 5,819,973 | A | 10/1998 | Traub, Sr. et al. | 220/271 |
| 5,967,726 | A * | 10/1999 | Turner et al. | 413/25 |

* cited by examiner

*Primary Examiner*—Allan N. Shoap
*Assistant Examiner*—Joseph C. Mereh
(74) *Attorney, Agent, or Firm*—Edward L. Levine

(57) ABSTRACT

An improved can end, and method for making a can end, for pressurized beverage containers with a stay on tab. The tab incorporates a raised region with a hole. The raised region is positioned to receive the vapor vented from the can upon initial lifting of the tab. The raised region and hole are sized and shaped to discharge the vapor from the region, through the hole, and into the surrounding environment, appearing as a mist or cloud. Among other configurations, the raised region can be shaped as the top half of a bubble or a crescent, and the opening can be circular or elongated.

16 Claims, 7 Drawing Sheets

EASY-OPEN MISTING CONTAINER

BACKGROUND OF THE INVENTION

The present invention relates to beverage cans having easy-open ends, and particularly to pressurized beverage containers for products such as beer and soft drinks. The invention particularly includes an improved can end that provides a visible, directed vent discharge.

Most consumers are familiar with metallic beverage containers having easy-open ends and containing soft drinks or beer. And, most consumers are equally familiar with the associated marketing efforts, including the use of various decorations, trademarks, markings, colors, shapes and other indicia on the cans used to differentiate among the contained products and the producers. Producers are constantly searching for ways to differentiate their product from those of others. In addition to the product, the package often serves as a significant feature of this differentiation.

Many of the metallic cans for holding beverages or other products are provided with easy-open can ends having attached pull tabs. The pull tab is attached to the can end by an integral rivet. The can end has a tear strip defined by a score. The pull tab is lifted and then pulled or torn to provide an opening defined by the tear strip through which the contents can then be poured. Consistent with ecological and safety considerations, the tear strip and tab, under normal conditions, remain connected to the can end.

When opening a carbonated or pressurized can, the consumer typically hears a venting from the can on lifting of the tab, and is aware that continued movement forces the tear strip, defined by the score, downwardly into the can. The score used in most cans today includes the formation of a vent region adjacent the rivet. Although it may appear to the consumer to be a single action of lifting and pulling the tab, basically this can end construction provides an initial opening of the score at the vent region in response to the lifting of the rivet by the tab. This action is followed by further fracture of the score line as a nose of the tab presses downwardly on the tear strip. In the can industry, this is often referred to as an initial "pop" followed by a "push." During the initial pop, pressure contained within the can is vented. This involves the venting of gas, typically carbon dioxide or nitrogen, which disperses broadly from the vent region generally laterally along the surface of the can end beneath the tab and into the surrounding environment. A purpose of the initial venting is to relieve pressure and avoid what is referred to as "missiling" of the tear panel. Accordingly, it has been desired to broadly dissipate the vented gas. A typical easy-open can end construction, including an anti-missile feature, is taught in U.S. Pat. No. 5,738,237, incorporated herein by reference. Further, the industry has viewed the discharge from a container as an undesirable feature, as discussed in U.S. Pat. No. 4,928,845 which teaches a throttle device as a safety feature against spraying from the can. U.S. Pat. No. 4,741,451 discloses another structure wherein a closure block on the interior of a can holds a lever portion of a pull tab which is pulled away from an aperture to allow venting from the can.

Although beverage cans are quite common and used throughout the world every day, the manufacturing technology involved is far from simple, and the capital investment in manufacturing machinery and tooling to manufacture the cans and can ends is substantial. It is not uncommon, for example, to use a 13 station die set to produce merely the tab. Exemplary methods of tab construction are taught in U.S. Pat. No. 4,465,204, the contents of which are incorporated herein by reference. Once in operation at the large volumes and high speeds of the can making industry, the can makers prefer to avoid major changes to the manufacturing systems, equipment and tooling.

While use of easy-open cans is widely and well received, it is desirable to provide a can including an improved can end which not only functions in the easy-open manner described above, but which also provides an additional method of product differentiation. It is further desirable to provide such improved cans without excessive modification of existing can manufacturing processes, equipment and tooling.

SUMMARY OF THE INVENTION

This invention provides a can having an improved easy-open can end, and method of manufacturing the end, which discharges a visible mist on opening of a pressurized can. It provides this feature through structure which does not require excessive modifications of the can end or the can end manufacturing processes, equipment and tooling.

In preferred form merely the tab is modified. A typical tab includes a rearward finger portion and a forward nose portion. As is typical in the art, the tab is mounted to the can end by a rivet and positioned such that the nose extends over the tear strip which is defined by the score. The score includes a vent region which is positioned adjacent the rivet. A typical tab includes a face portion extending between the rivet and the nose. Accordingly, the face portion extends over the vent region of the score. In accordance with the invention, the face portion is provided with a raised section having an opening such as a circular hole. The raised section extends over the vent region such that upon lifting of the tab, most of the gas discharged from the vent region is directed generally upwardly into the volume defined by the raised section, and then through the opening in the raised section. The raised section and opening are sized and shaped to cause the gas to discharge through the opening as a visible mist.

While many configurations are possible, such as a hemispherical bubble having a circular hole, a preferred raised section is a semi-circular or crescent shaped structure having an opening which is elongated, circular or oval.

The modification of a typical prior art tab forming process can readily involve the addition of steps during or at the end of the tab forming manufacturing process whereby the raised section and opening are formed. As desired, new tabs can be specifically configured and positioned to provide a raised section which receives the vented gas and an opening through which it will be dispersed.

BRIEF DESCRIPTION OF THE DRAWINGS

The advantages, nature and additional features of the invention will become more apparent from the following description, taken in connection with the accompanying drawings, in which.

DESCRIPTION OF THE PREFERRED EMBODIMENTS

Figure 1:
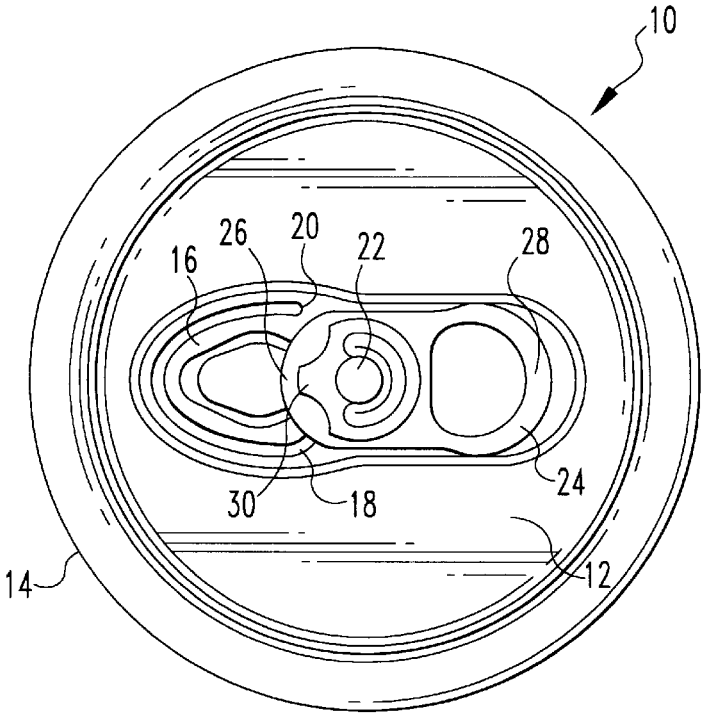
FIG.1 PRIOR ART
FIG. 1 is a plan view of a prior art easy-open can end.
Figure 2:
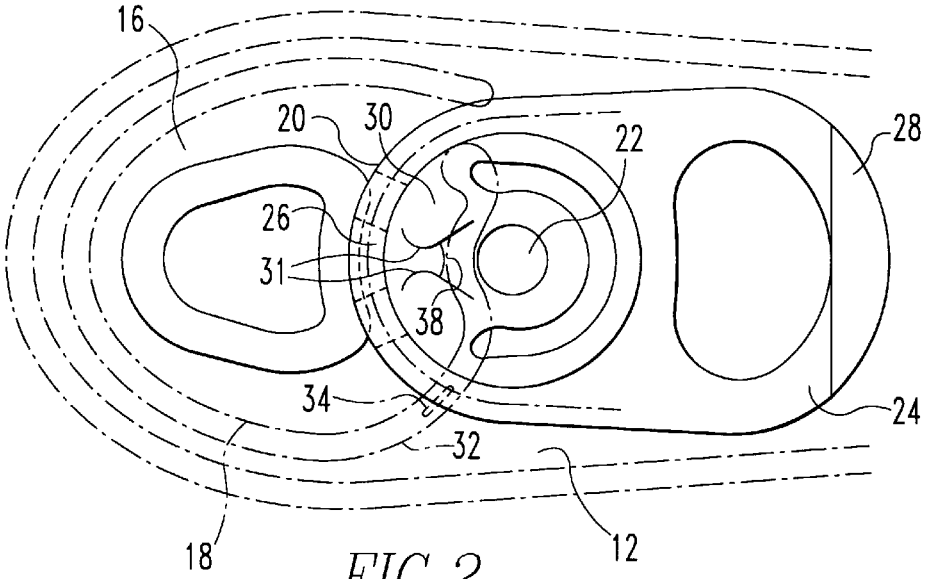
FIG.2 PRIOR ART
FIG. 2 is a plan view of a portion the prior art can end of FIG. 1 showing additional detail of the tab and showing score and contour lines in phantom.
Figure 3:
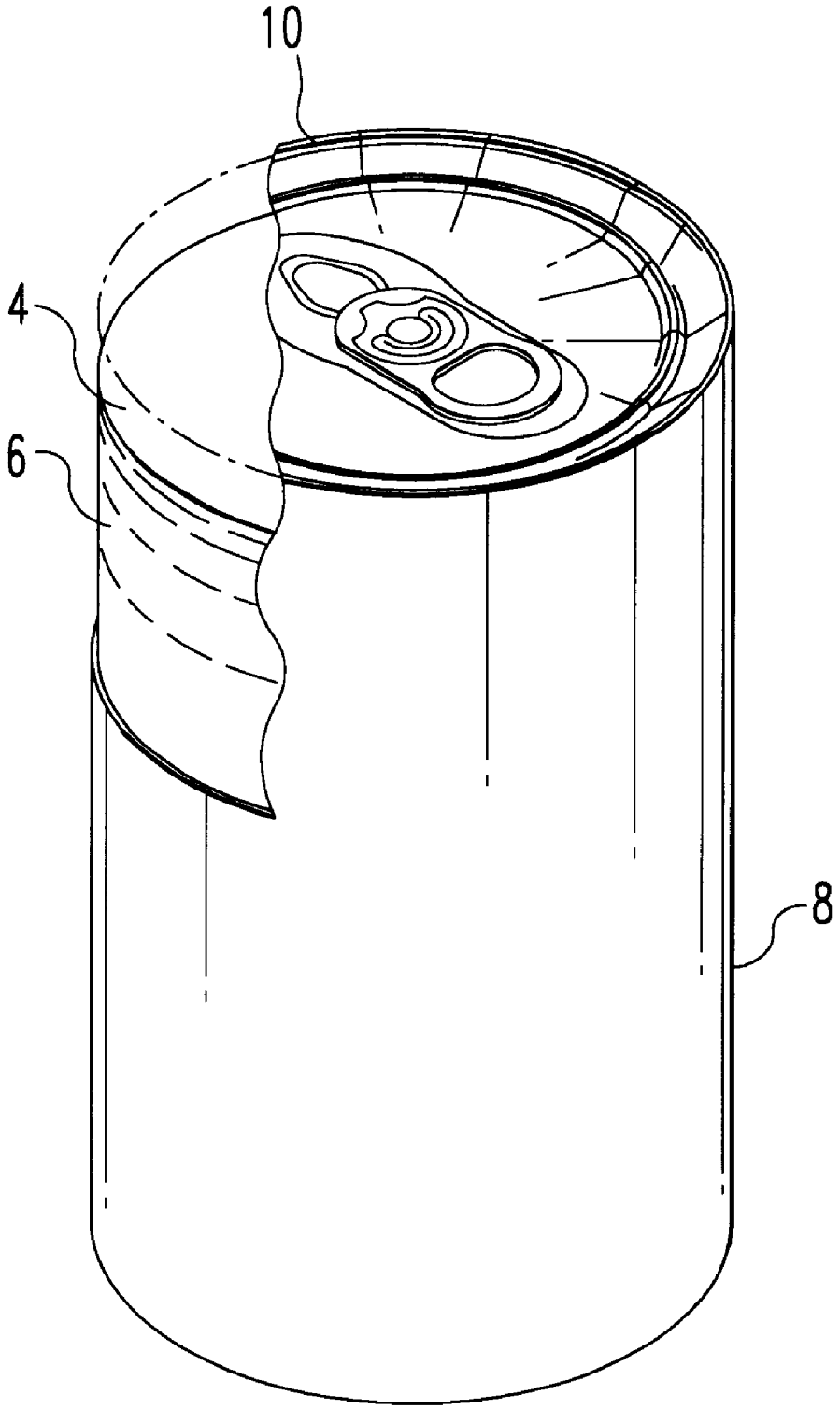
FIG. 3 is a perspective view showing a can body with an attached can end.

Referring now to FIGS. 1 and 2 there is shown an exemplary prior art can end 10. Can end 10 has an end panel 12 of generally circular shape which includes a circumferentially extending raised edge 14 for attaching the can end 10 to a suitable cylindrical beverage can or the like. The can end 10 is preferably manufactured of a relatively ductile metal such as aluminum, but may be made from other materials. Can ends 10 of the prior art or of the inventive type herein described are attachable to a can body 8 as shown schematically in FIG. 3. Within the can is a beverage 6 and a head space 4 above the beverage 6.

A retained tear strip 16 extends across can end 10 from a position spaced inwardly of raised edge 14 to approximately the center of can end 10. Tear strip 16 is defined by a generally U-shaped or V-shaped score 18 with open end 20 of the V or U shape positioned toward the center of the can end 10. The score 18 is interrupted so that the tear strip 16 will be captively retained on the underside of the can end 10 when opened.

An integral rivet 22 is positioned adjacent open end 20 of score 18, and a graspable ring-like pull tab 24 is secured to can end 10 by rivet 22. Pull tab 24 includes a forward nose portion 26 and a rearward finger portion 28. Pull tab 24 also includes a face portion 30 between the rivet 22 and the nose 26. As is well known in the art, the periphery of the tab 24 is typically formed by rolling the edges, and thus the periphery, such as the nose portion 26, is more rigid than the face portion 30. The face portion typically includes a profile 31 for added strength in this region.

As shown best in FIG. 2, in addition to the main score 18 forming the boundary of the tear strip 16, there is included an anti-fracture score 32 and an anti-missile score 34. A vent region 38 of the main score 18 adjacent rivet 22 is also shown. It is evident that the vent region 38 is covered by the face 30. Upon lifting of the finger portion 28 of the tab 24, the vent region 38 of the score 18 opens as the rivet 22 is initially lifted. A gaseous vapor is released from within the can and disperses laterally under the tab 24 and then into the surrounding environment. The face portion 30 of the tab 24 is thinner and not as rigid as the periphery of the tab 24, and bends in this face portion 30 as the tab 24 is lifted.

Figure 4:
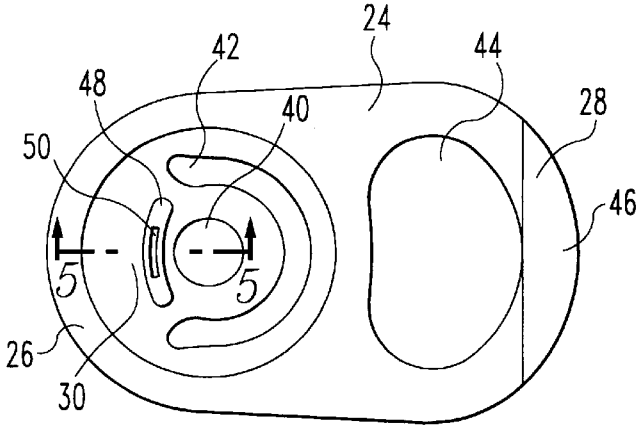
FIG. 4 is a plan view of a tab in accordance with the invention.
Figure 5:
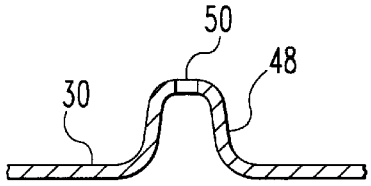
FIG. 5 is an elevational cross section view taken at V—V of FIG. 4.

Referring now to FIG. 4 there is shown a tab 24 in accordance with the invention, having a nose portion 26, finger portion 28, and face portion 30. As formed, the tab 24 includes a rivet hole 40, a forming cavity or tongue 42, a finger cavity 44 and a gripper rise 46. All of these features are well known in the art, as is the fabrication process by which the tab 24 is attached to the can end 10. The inventive embodiments include a raised section 48 rising from the face portion 30. The raised section or store 48 includes an opening 50 therethrough as shown in FIG. 4 and FIG. 5. The raised region 48 defines a volume for receiving and then discharging a vented vapor, as described further below.

Figure 6:
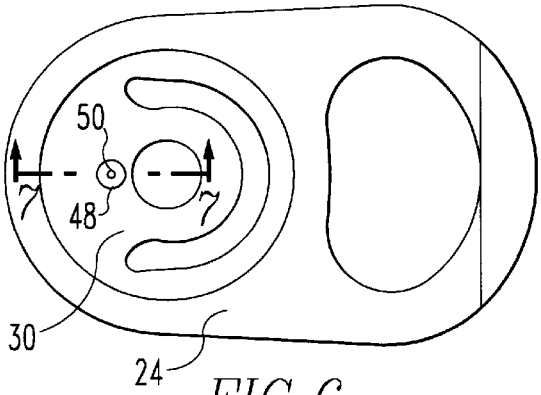
FIG. 6 is another plan view of a tab in accordance with the invention.
Figure 7:
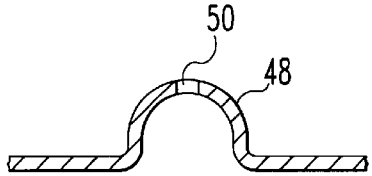
FIG. 7 is an elevational cross section view taken at VII—VII of FIG. 6.
Figure 8:
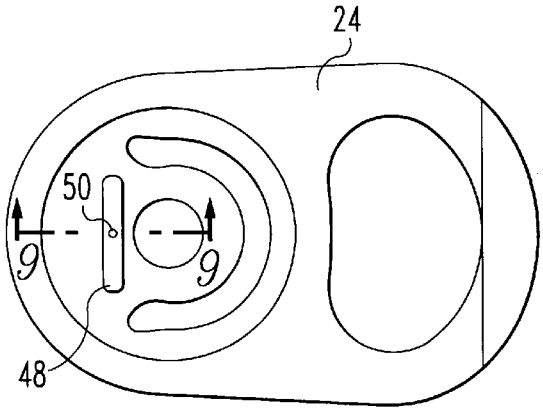
FIG. 8 is another plan view of a tab in accordance with the invention.
Figure 9:
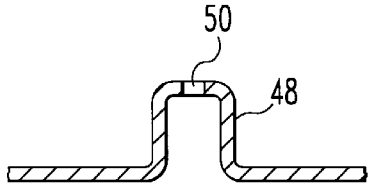
FIG. 9 is an elevational cross section view taken at IX—IX of FIG. 8.
Figure 10:
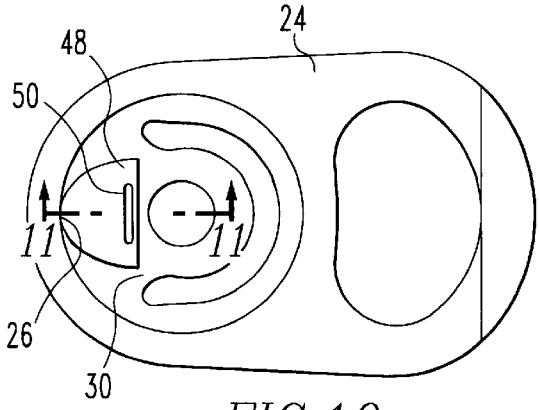
FIG. 10 is another plan view of a tab in accordance with the invention.
Figure 11:
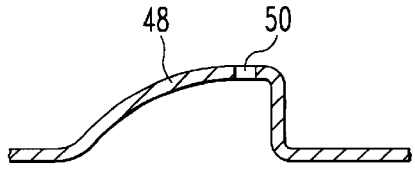
FIG. 11 is an elevational cross section view taken at XI—XI of FIG. 10.
Figure 12:
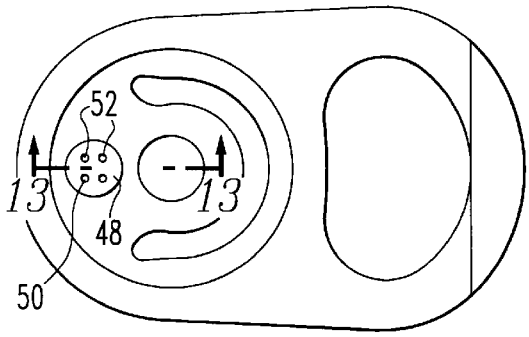
FIG. 12 is yet another plan view of a tab in accordance with the invention.
Figure 13:
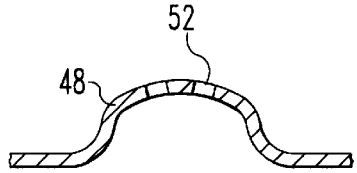
FIG. 13 is an elevational cross section view taken at XIII—XIII of FIG. 12.

Alternative configurations of the raised section 48 and opening 50 are shown in FIGS. 6 through 13. FIGS. 6 and 7 show a raised section 48 generally round in cross section, being generally hemispherical, and having a round or circular opening 50. This appears as a portion of a round bubble rising from the face 30 and having a circular opening. FIGS. 8 and 9 show an elongated raised section 48 being generally rectangular in cross section and having a round opening 50. FIGS. 10 and 11 show a raised section 48 being in the shape of a half-moon bubble and having an elongated opening 50. Here the raised section 48 extends to the rolled edge of the nose 26, which has been found to be desirable as it aids in maintaining the strength of the face portion 30 of the tab 24 and sufficiently contains the vapor discharged into the raised portion 48. Generally, the raised portion, if not overly large, may provide to the face 30 a strengthening similar to that of the profile 31 (FIG. 2). FIGS. 12 and 13 show a raised section 48 generally round in cross section, as a hemisphere, and having an opening 50 which is a plurality of round opening holes 52. It has been found that an elongated raised section 48, as compared to a round raised section 48, tends to better retain vapor within the raised section with less lateral discharge that bypasses passing through the opening 50. The raised portion 48 is preferably vertically aligned above at least a portion of the vent region 38, as shown in FIG. 2.

Figure 15:
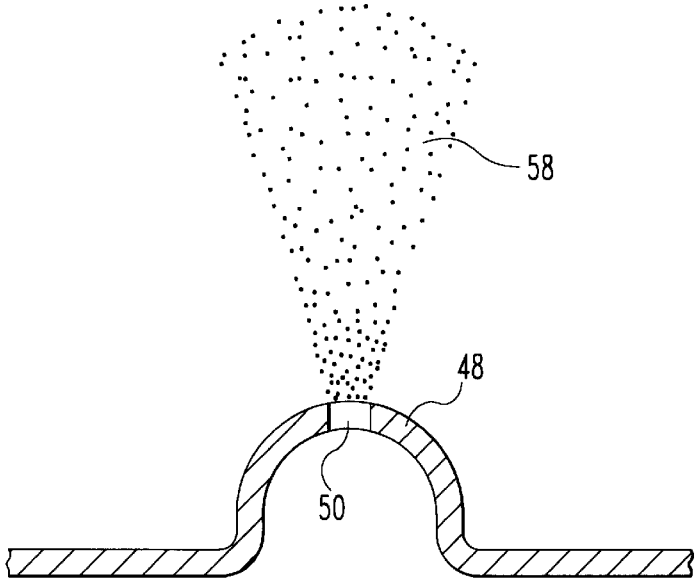
FIG. 15 is a schematic cross section view illustrating a vent mist in accordance with the invention.
Figure 14A:
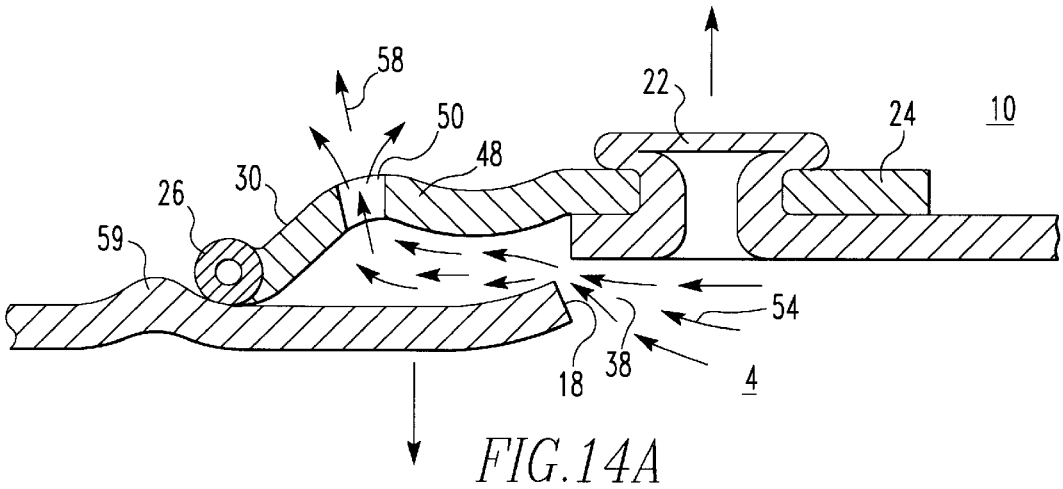
FIG. 14A is an elevational cross section view of the central region of a can end in accordance with the invention.

Referring now to FIG. 14A, there is shown a schematic of the central portion the inventive can end 10. At this stage of operation, the tab 24 has been lifted sufficiently to fracture the score 18 at the vent region 38. Pressurized gas or vapor 54 is discharged from the head space 4 in the interior of the can body 8 through the open vent region 38, communicates into the raised portion 48 and through the opening 50 into the surrounding environment. The discharge of the vapor along this path forms an ejection mist 58 of the type shown in FIG. 15. The appearance of the mist 58 will vary depending on a number of variables, including the type of vapor and its temperature and pressure within the interior 56 of the can, the conditions of the ambient environment, the volume and configuration of the raised portion 48, and the configuration and area of the opening 50. It has been found, however, that by use of the raised section 48 and opening 50 to control the discharge as compared to prior art systems, the discharge can be sufficiently focused under anticipated conditions to create a visible mist. From an aesthetic standpoint, it is deemed to be desirable that the mist 58 be visible and form a cloud or a fan or wedge shape. Where the product contained within the can is a carbonated soft drink or beer, the mist is anticipated to contain carbon dioxide, with or without some vaporous form of the product. Typically the mist 58 is initially visible, and then dissipates into the surrounding environment. A residue may remain on the can end 10. Also illustrated in FIG. 14A is an inner bead 59 which functions for the nose 26 to react against on initial opening, which is typical of many prior art can end designs.

Figure 14B:
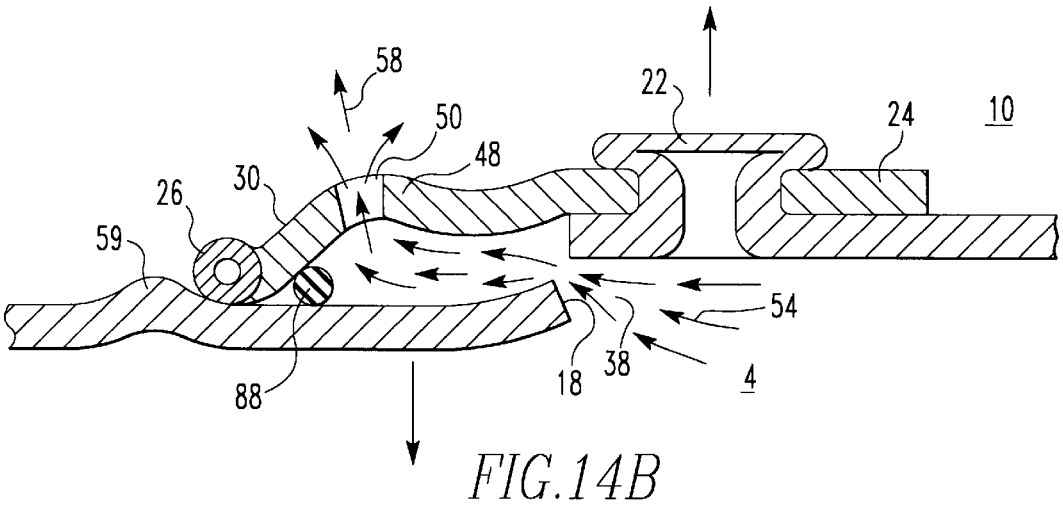
FIG. 14B is a view similar to FIG. 14 showing a seal on the can end.

It has been found that the area of the discharge opening 50 is one of the most important factors in controlling the appearance and formulation of the mist 58. If the opening 50 is too small and restrictive, either the mist 58 is discharged as too narrow and harsh a stream, or the venting is overly constrained and no mist is formed. If the opening is too large, the vapor vents quickly and a visible mist is not formed. It has also been found that if the raised section 48 is too large compared to the face portion 30, it may excessively weaken the tab which could fail upon lifting. It is also desirable that the face portion 30 of the tab 24 fit snugly against the end panel 12, to create a loosely sealed area from which the raised portion 48 rises. As shown in FIG. 14B, a seal 88, such as a polymer, can be included to enhance the containment of the vapor within the raised portion 48 and alleviate discharge other than through the opening 50. The seal 88 preferably extends approximately 180° about the nose 26 of the tab 24 and is affixed to the bottom of the pull tab 24 prior to attachment of the tab 24 onto the can end 10. The process of fixing the tab 24 onto the can end 10 is well known to those skilled in the art, and includes actual formation of the rivet 22 from a rivet button on the end panel 12 such that the tab 24 is captured through the rivet hole 40.

A visible mist on opening can function as one feature to differentiate the product within the can from the product of others, and provides a pleasing alternative to the consumer.

Figure 16:
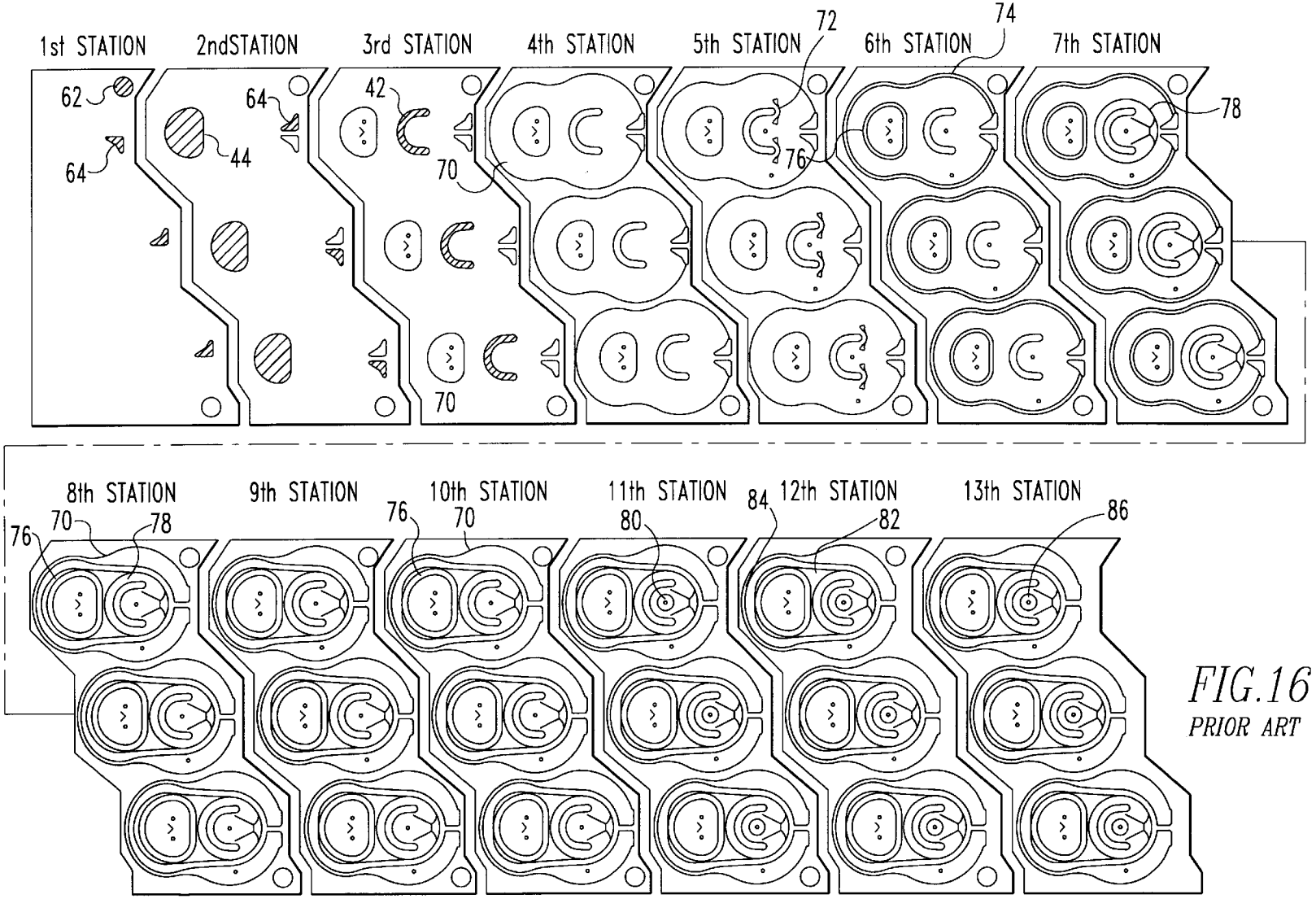
FIG. 16 PRIOR ART
FIG. 16 is a layout of a prior art pull-tab manufacturing sequence.

Referring now to FIG. 16 there is shown a typical three out prior art manufacturing sequence for formation of a pull tab 24 in accordance with manufacturing machinery and tooling of Stolle Machinery, Inc. of Sidney, Ohio. As shown, it involves 13 sequential tooling die stations. Tab sheet stock 60 of aluminum, for example standard alloy 5182 of 0.010 to 0.011 inches thick, is passed through the sequence. In the first station tab stock pilot holes 62 and carry strip holes 64 are pierced. In the second station additional carry strip holes 64 and the finger cavities 44 are pierced. In the third station the forming cavity or tongue 42 is pierced. In the fourth station the outside contour 70 of the tab is lanced. In the fifth station the tongue 42 is reformed as indicated at reference numeral 72. In the sixth station the tab contour is precurled 74 and the finger hole is precurled as indicated at numeral 76. In the seventh station the area around the rivet location is formed downward, into a panel form indicated at reference numeral 78. In the eighth station the outside contour 70 and precurled finger hole 76 get a 90 degree wipedown and a panel form 78 restrike. The ninth station is idle. In the tenth station the outside contour 70 and finger hole 44 get curled. In the eleventh station a rivet hole 80 is pierced. In the twelveth station the tab reform and tip up operation is performed, indicated respectively by reference numerals 82 and 84. And, in the thirteenth station the rivet hole 80 is reformed, indicated at reference numeral 86.

Figure 17:
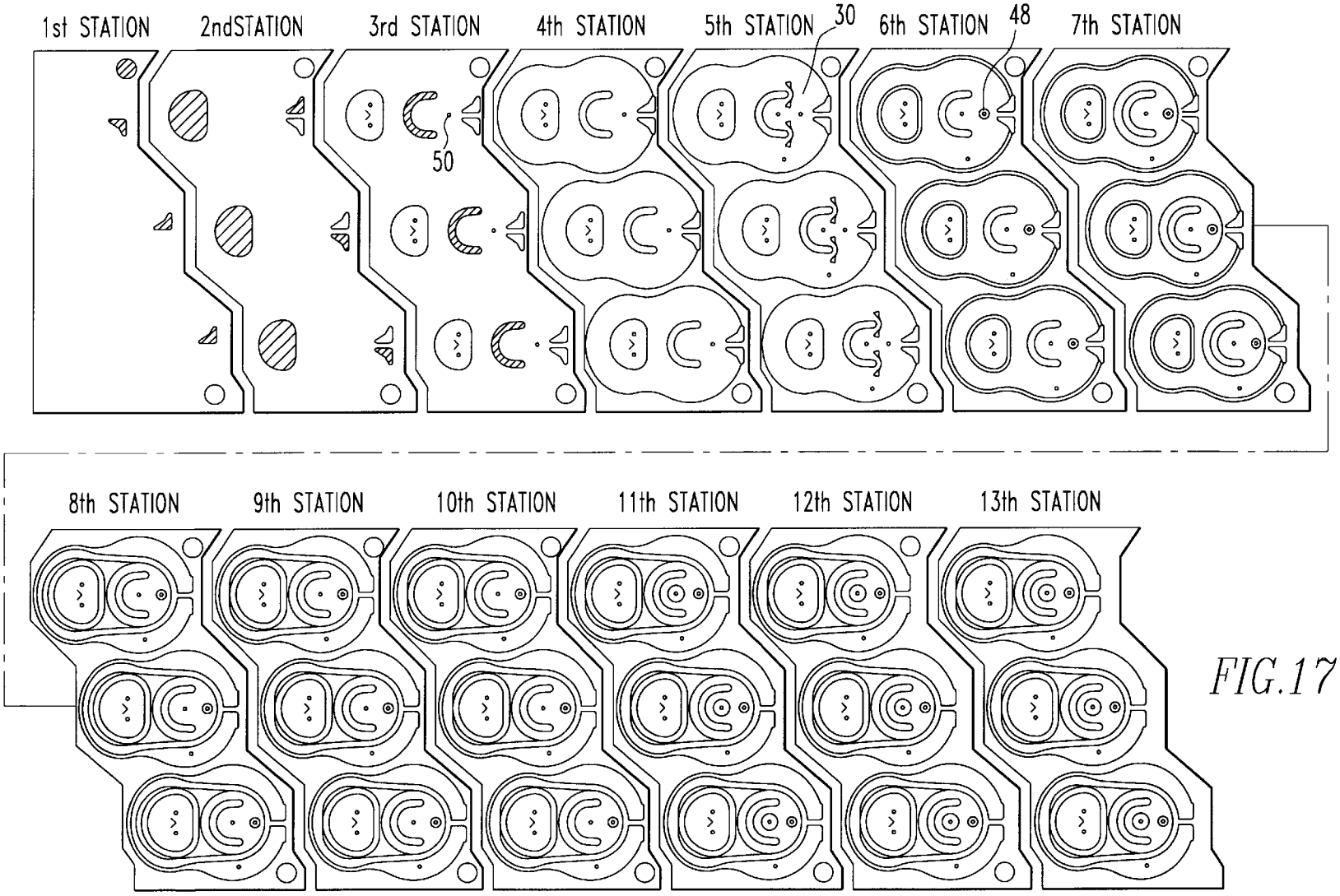
FIG. 17 is a layout of a pull-tab manufacturing sequence in accordance with the invention.

In accordance with the inventive method, this manufacturing sequence is improved to include formation of the raised portion 48 and opening 50. One contemplated implementation of this improvement as shown in FIG. 17 is piercing of the face portion at the third station to form the opening 50, and forming the raised portion 48 in the sixth station. Other sequences can be utilized, including modification of the existing stations or providing one or more additional stations. If a seal 88 is utilized, it can be added after formation of the tab 24 and prior to connection of the tab 24 to the can end 10.

A series of tests was performed to compare various sizes and configurations for the raised portion 48 and opening 50. Beverage can bodies 8 of the 12 ounce size were filled and various embodiments of the inventive can end 10 were sealed onto the bodies 8. Some of the cans were filled with beer, and some with carbonated beverage. Several tab designs presently in use on the commercial market were utilized, and the results did not vary among these types. The results are presented in Table I. In Table I, "Small bubble raised portion" is a bubble or hemispherical style raised portion 48 (as shown in FIGS. 6 and 7) ⅛ inch diameter at its widest cross section, and ⅛ inch deep (rising ⅛ inch from the face 30); "Large bubble raised portion" is a bubble or hemispherical style raised portion 48 (as shown in FIGS. 6 and 7) 3⁄16 inch diameter at its widest cross section and ⅛ inch deep; "Half moon raised portion" is a raised portion 48 of the type shown in FIGS. 10 and 11, 5⁄16 inch long, 5⁄32 inch wide and ⅛ inch deep. "Double slit" refers to a hemispherical bubble style having two parallel slits; "Single slit" refers to a hemispherical bubble style having a slit across the raised bubble; and, "Radius slit" refers to semi-circular opening. "Small hole" refers to a 1⁄32 inch diameter opening; "Large hole" refers to a 1⁄16 inch diameter opening; "Elongated hole" refers to an opening 1⁄32 inch by 5⁄32 inch. The test tabs were made by taking standard commercial machine-made tabs and through a hand process, forming into these tabs the raised portion 48 and opening 50. The results column of Table I is a subjective determination of the degree to which the mist was aesthetically acceptable.

TABLE I

| ITEM | DESCRIPTION | RESULTS |
|---|---|---|
| A | Large bubble raised portion/multi holes | VERY POOR |
| B | Small bubble raised portion/multi holes | VERY POOR |
| C | Small bubble raised portion/large hole | POOR |
| D | Small bubble raised portion/small hole | VERY POOR |
| E | Large bubble raised portion/elongated hole | GOOD |
| F | Large bubble raised portion/small hole | FAIR |
| G | Large bubble raised portion/large hole | GOOD |
| H | Half-moon raised portion/large hole | VERY GOOD |
| I | Half-moon raised portion/elongated hole | VERY GOOD |
| J | No raised portion/elongated hole | NO MIST/ SOLID STREAM |
| K | No raised portion/large hole | NO MIST/ SOLID STREAM |
| L | Large bubble raised portion/double slit | POOR |
| M | Large bubble raised portion/double small hole | POOR |
| N | Small bubble raised portion/single slit | VERY POOR |
| O | Small bubble raised portion/radius slit | POOR |
| P | Large bubble raised portion/single slit | FAIR |
| Q | Large bubble raised portion/radius slit | FAIR |

Items J and K were tabs that included merely an opening, with no raised portion. Other opening shapes on tabs without a raised portion were tried and the results did not generate an aesthetically acceptable mist or were very inconsistent and less controlled. Test samples with tabs of the various sizes and shapes represented in Table I were also prepared with still water and pressurized liquid nitrogen in the cans. The results were similar to those presented in Table I, but were somewhat less intense than the response from cans filled with beer or carbonated beverages. In other terms, there was a somewhat less visible, but still acceptable, mist formation.

It is thus evident that can ends can be manufactured including inventive structure which provides a visible mist or cloud upon initial opening. This feature can be utilized to differentiate among producers and products, and to provide consumers with a desirable vision upon opening of a pressurized container. Many alternatives are possible. For example, the size, configuration and position of the raised region or receiving reservoir and of the opening can be of numerous variations, provided that the raised reservoir receives the initial vent discharge through the vent region of the score. And, the manufacturing sequence to provide the raised region and opening can be adjusted consistent with minimizing the impact on existing systems and tooling.

We claim:

1. In an easy open can end having a score defining a tear strip and a vent score portion, a rivet, and a pull tab secured to said can end by means of said rivet to open said vent score and subsequently said tear strip upon lifting of said pull tab, said pull tab having a forward nose and a face portion extending between said rivet and said nose, said face portion extending over and circumferentially about said vent score, the improvement comprising:

said pull tab including in said face portion a raised reservoir rising from and surrounded by said face portion, said raised reservoir being positioned above said vent score portion and positioned to provide fluid communication between said vent score portion and said raised reservoir, said raised reservoir including an opening therethrough.

2. The improved can end of claim 1 wherein said raised portion is generally circular in cross section.

3. The improved can end of claim 1 wherein said opening has a long dimension and a short dimension.

4. The improved can end of claim 1 wherein said opening is a single aperture.

5. In an easy open can end having a score defining a tear strip and a vent score portion, a rivet, and a pull tab secured to said can end by means of said rivet to open said vent score and subsequently said tear strip upon lifting of said pull tab, the improvement comprising:

said pull tab including a raised portion positioned above said vent score portion, said raised portion including an opening therethrough, said opening being a plurality of apertures.

6. The improved can end of claim 1 wherein said opening is round and approximately 1/16 inch in diameter.

7. The improved can end of claim 1 wherein said opening is semi-circular.

8. The improved can end of claim 1 wherein said raised portion is shaped as a semi-circle in cross section.

9. In an easy open can end having a score defining a tear strip and a vent score portion, a rivet, and a pull tab secured to said can end by means of said rivet to open said vent score and subsequently said tear strip upon lifting of said pull tab, the improvement comprising:

said pull tab including a raised portion positioned above said vent score portion, said raised portion including an opening therethrough, and said can end including an end panel and said tab including a seal contacting both the bottom of said tab and said end panel, said seal partially surrounding said raised portion.

10. A can containing in its interior a beverage under pressure, said can including a can body and a can end sealed atop said can body, said can end comprising:

a panel having a rivet and a score defining a vent region and a tear strip;

a tab affixed to said rivet, said tab having a nose portion extending over said tear strip and a face portion extending between said rivet and said nose portion, said face portion extending over and circumferentially about said vent region;

said face portion having a raised region, said raised region rising from and surrounded by said face portion and having an opening therethrough, said raised region being positioned above said vent region and positioned to provide fluid communication between said vent region and said raised region so as to receive vapor discharged from said can interior passing through said vent region, and to discharge said vapor from said raised region through said opening as a visible mist.

11. The can of claim 10 wherein said opening is a hole approximately 1/16 inch in diameter.

12. The can of claim 10 wherein said opening is elongated having dimensions approximately 1/32 inch by 5/32 inch.

13. A method of manufacturing a tab for an easy-open can end, comprising:

forming a tab having a finger portion, a rivet hole, a nose portion, and a face portion located between said rivet hole and nose portion; and forming in said face portion a raised reservoir having an opening therethrough, said opening being a plurality of apertures.

14. A pressurized beverage container comprising:

a cylindrical can body;

a can end sealed to said can body, said can end having a raised edge circumferentially surrounding an end panel, said end panel having a centrally located rivet and a score defining a tear strip and a vent region adjacent said rivet, a pull-tab affixed about said rivet at a rivet hole and having a finger portion, a nose portion, and a face portion extending between said rivet hole and said nose portion and extending over and circumferentially about said vent region, said face portion having a raised portion rising from and surrounded by said face portion, said raised portion having an opening therethrough and being positioned to provide fluid communication between said vent region and said raised portion, said raised portion and opening being sized and configured such that upon lifting of said pull-tab at said finger portion said vent region opens and vapor is discharged through said vent region, into said raised portion and through said opening to create a visible mist.

15. The pressurized beverage container of claim 14 said mist is shaped as a wedge.

16. The pressurized beverage container of claim 15 wherein said raised portion is shaped as a crescent.

* * * * *